United States Patent [19]

Young

[11] Patent Number: 4,513,505

[45] Date of Patent: Apr. 30, 1985

[54] DEVICE FOR INDICATING THE POLAR COORDINATE POSITION OF A GIVEN POINT ANYWHERE WITHIN A CIRCULAR AREA

[75] Inventor: William C. Young, Moorestown, N.J.

[73] Assignee: RCA Corporation, Princeton, N.J.

[21] Appl. No.: 562,517

[22] Filed: Dec. 19, 1983

[51] Int. Cl.[3] ..... G01B 3/00

[52] U.S. Cl. ..... 33/1 MP; 33/1 SD

[58] Field of Search ..... 33/1 MP, 1 C, 1 N, 431, 33/1 SD

[56] References Cited

U.S. PATENT DOCUMENTS

| | | | |
|---|---|---|---|
| 2,264,279 | 12/1941 | Dearing | 33/1 MP |
| 2,350,424 | 6/1944 | Smith | 33/431 |
| 2,482,105 | 9/1949 | Duggar | 33/1 MP |
| 2,999,635 | 9/1961 | Robertson | 33/1 SD |
| 3,497,678 | 2/1970 | Warner | 33/431 |
| 4,287,496 | 9/1981 | Young | 333/248 |

*Primary Examiner*—Willis Little

*Attorney, Agent, or Firm*—Joseph S. Tripoli; George E. Haas; William Squire

[57] ABSTRACT

A fixed member has angular indicia circumscribing a given area. A first disc is rotatable about an axis at its center and at the center of the angular indicia, and a second disc is rotatably secured to the first disc about an axis parallel to the axis of rotation of the first disc. Bridging lines on the first disc couple a reference point on the second disc to angular scalar indicia on the fixed member to indicate the relative angular position of the reference point with respect to the axis of rotation of the first disc. Radial displacement indicia on the surface of the first and second discs indicate the relative radial displacement of the reference point from the axis of rotation of the first disc along a radial line through that axis.

9 Claims, 3 Drawing Figures

DEVICE FOR INDICATING THE POLAR COORDINATE POSITION OF A GIVEN POINT ANYWHERE WITHIN A CIRCULAR AREA

This invention relates to devices for indicating the polar coordinate position of a given point which may be positioned anywhere within a given circular area.

My U.S. Pat. No. 4,287,496, discloses an assembly for positioning the coupling probe of a waveguide. Disclosed are first and second circular cylinder-like members, the first located in a wall of the waveguide and rotatable about its center axis, and the second within the first member and rotatable about a central axis which is offset from the central axis of the first member. A coupling probe extends through the second cylinder-like member near the periphery thereof. The structure includes a waveguide subtending the first and second cylinder-like members. The first and second cylinder-like members are constructed so that the second can rotate within the first and the first cylinder-like member can rotate relative to the waveguide. The position of the coupling probe is adjusted by rotation of the first and second cylinders. The coupling probe is moved to different positions until the reflected power measured is at a minimum. Because the coupling probe is secured to a rotating cylinder and that rotating cylinder is also secured, in turn, to a second rotating cylinder, the position of the probe is located anywhere within a given circular area. It is desirable, however, to know the exact position of the probe. To do so, requires ascertaining the polar coordinate position of the probe relative to the axis of rotation of the first cylinder-like member and to some angular reference position.

The device according to the present invention for indicating the polar coordinate position of a given point anywhere within a given area lying within a plane comprises a member including means bounding said area and having angular scalar indicia thereon circumscribing the area. A first element is rotatably secured to the member for rotation about a first axis at the origin of the angular scalar indicia normal to the plane, a portion of the element of a given angular extent being adjacent the scalar indicia. A second element is rotatably secured to the first element for rotation about a second axis spaced from and parallel to the first axis, the second axis rotating with the first element about the first axis. The second element includes first and second indicia, the first indicia representing the location of the point. The first element includes third and fourth indicia, the third indicia being positioned and formed on the first element to couple the first indicia to the scalar indicia for indicating the angular location of the given point with respect to a reference point coincident with the first axis. The second and fourth indicia are positioned and arranged to provide radial reference indicia on one of the elements aligned with radial displacement scalar indicia on the other element to indicate the value of the relative radial displacement of the given point with respect to the reference point at that angular location. The radial displacement scalar indicia has an extent representing the maximum radial displacement of the given point from the reference point.

Figure 1:
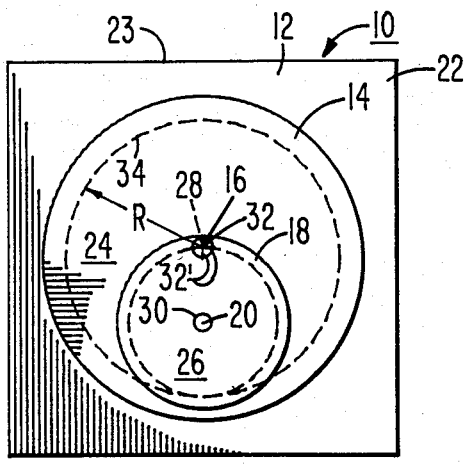
FIG. 1 is a plan view of a mechanism which is capable of moving a reference point anywhere within a circular area.
Figure 3:
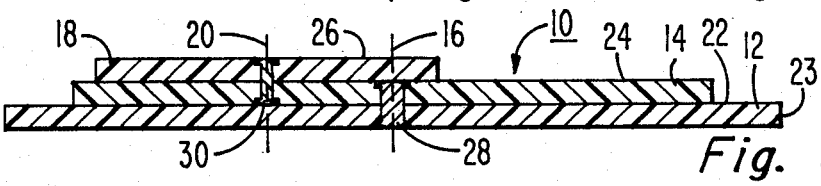
FIG. 3 is a sectional elevation view of the device of FIG. 2 taken along lines 3—3.

In FIG. 1, mechanism 10 comprises a fixed member 12, an outer circular disc 14, rotatably secured to the fixed member 12 for rotation about its central axis 16, and an inner circular disc 18, rotatably secured to the outer disc 14 for rotation about the inner disc 18 central axis 20 which is offset from axis 16. In FIGS. 1 and 3 the fixed member 12 may be a square element and has a broad flat surface 22 and a relatively thin section or thickness. The discs 14 and 18 may be of similar construction having their respective broad surfaces 24 and 26, respectively, parallel to the broad surface 22 of the fixed member 12. By way of example, the fixed member 12 and the discs 14 and 18 may be constructed of thin stiff material, such as cardboard or transparent thermoplastic sheet material. In this example, the outer disc 14 is rotatably secured to the fixed member 12 by recessed rivet 28 and the inner disc 18 is rotatably secured to the outer disc 14 by rivet 30.

However, the above structure may take other configurations. For example, in the aforementioned U.S. Pat. No. 4,287,496, the fixed member 12 can be the wall of a waveguide structure. The outer disc 14 can be the first cylinder-like member located in the wall of the waveguide and the inner disc 18 can be the second cylinder-like member nested within the outer disc 14. The outer disc 14 in that embodiment has a circular peripheral flange resting on a circular stepped shoulder in a circular aperture in the waveguide wall. The inner disc 18 has a circular peripheral flange resting on a circular stepped shoulder in a circular aperture in the disc 14, as described more fully in the aforementioned patent. In that structure, the outer disc 14 flange slidably engages the circular stepped shoulder in the fixed member 12, and the inner disc 18 flange slidably engages the stepped circular shoulder in the outer disc 14.

Generally, the outer disc 14 rotates about its central axis 16, FIG. 1, and the inner disc 18 rotates about its central axis 20 which is secured for rotation with the outer disc 14 about the latter axis 16. Thus, the discs 14 and 18 can be nested, as shown in the aforementioned patent, or layered, as shown in FIG. 3.

The device of the present invention accurately indicates the polar coordinates of a datum or reference point 32 represented by the intersection of cross hair lines 32'. In FIG. 1, point 32 is coincident with axis 16 which serves as a reference location for point 32. Reference point 32 can be located anywhere within the area defined by dashed circle 34 by rotation of the discs 14 and 18. The dashed circle 34 is concentric with primary axis 16 and lies within and is concentric with the periphery of the outer disc 14. In the aforementioned U.S. patent the coupling probe of the structure described therein represents the reference point 32. Therefore, the device of the present invention can identify the polar coordinates of that coupling probe regardless its position anywhere within the area of dashed circle 34 (which also defines the region in which the probe can be located). The identification of the coupling probe polar coordinates facilitates the assembly and construction of subsequent coupling probes to their corresponding waveguides once the optimum position of the probe is determined as described in the aforementioned patent.

Figure 2:
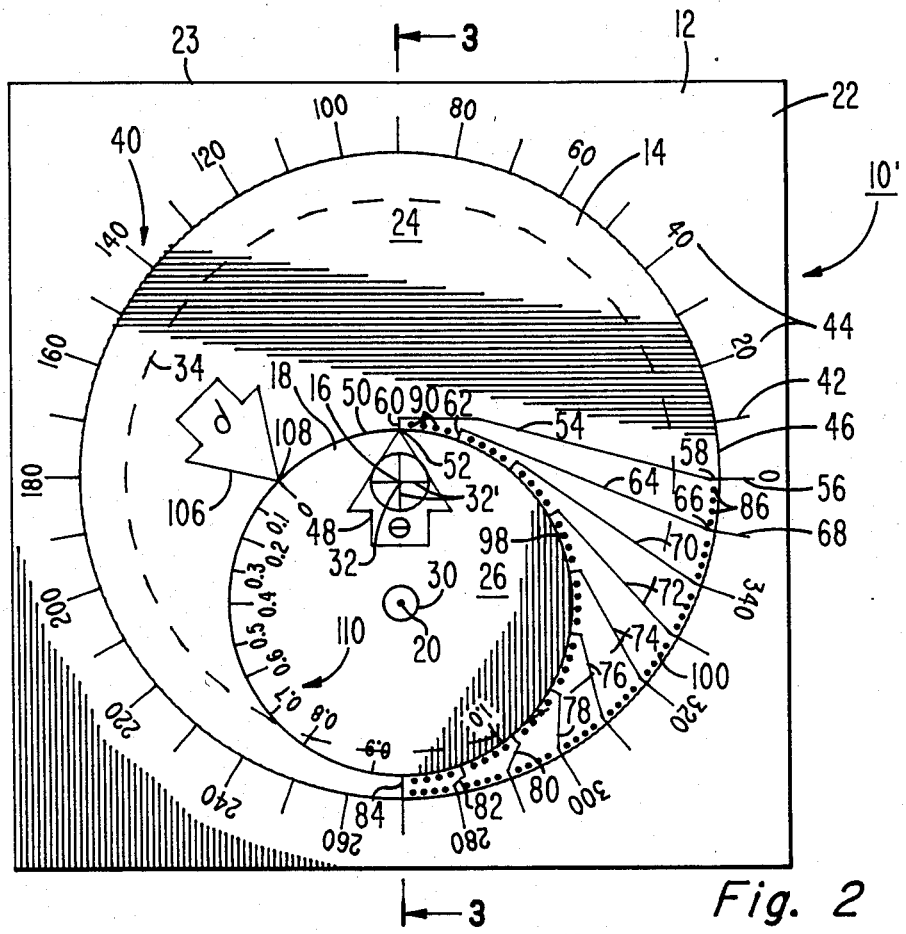
FIG. 2 is a plan view of an embodiment of the present invention employing the mechanism of FIG. 1 for providing polar coordinate information to locate the polar coordinate position of the point that is moved by the mechanism of FIG. 1.

The device 10' of FIG. 2 includes the mechanism 10 of FIG. 1 with indicia added to the relatively fixed member 12 and the rotatable discs 14 and 18 for providing polar coordinate position information of the reference point 32 anywhere within the region or area of the dashed circle 34 to which point 32 can be located. This polar coordinate information includes angular displacement information $\theta$ and radial displacement information $\rho$ relative to the origin of the angle $\theta$ and a radial line from the origin of angle $\theta$.

In FIG. 2, the broad surface 22 of fixed member 12 is marked with angular scalar indicia 40 which circumscribes the disc 14 and the circular area enclosed by dashed line 34. The circle scaled by the angular indicia 40 may be marked in 10° increments by graduations 42. The increments employed are determined by legibility and accuracy requirements; the smaller the increment, the more accurate the reading of the indicia. The relative angular values may be marked by the numerals 20, 40, 60, and so forth, designated as 44. The 0° angle graduation 56 comprises a starting or reference point. The outer edge 46 of the outer disc 14 may overlie or be adjacent to the indicia 40, as shown.

The inner disc 18 is marked with the reference point 32 (the intersection of cross lines 32') on its broad surface 26 close to edge 50. The reference point 32 in the representative orientation of the inner disc 18 is coincident with primary axis 16 about which the outer disc 14 rotates. An arrow 48 or other suitable indicia such as a straight line is marked on the broad surface 26 of the inner disc 18 to point to the edge 50 of the disc. The line or arrow 48 is centered on a line passing through the axis 20. The position of the inner disc 18 and, thus, arrow 48, in this orientation, comprises a reference location of the indicator point 32. The point 52 of arrow 48 is contiguous with the edge 50 of the inner disc 18 and is aligned with and points to the end 60 of line 54 on surface 24 of outer disc 14.

The other end 58 of line 54 points to and is aligned with the 0° angular reference indicia 56 on the fixed member 12. The line 54, therefore, serves to bridge and couple the position of arrow 48 to indicia 40. This coupling indicates the angular coordinate (thus the angular displacement) of the point 32 relative to the primary axis 16. Obviously, at this position, since the point 32 is coincident with the primary axis 16, the angular displacement of the point 32 with respect to this axis 16 is zero. Therefore, line 54, by coupling arrow 48 to the 0° indicia 56, indicates the relative angular displacement of the reference point 32.

In addition to line 54, an array of additional bridging or coupling lines 64, 70, 72, 74, 76, 78, 80, 82, and 84 are marked on the broad surface 24 of outer disc 14. One end of each line of the array points to and is aligned with a separate, different graduation of angular indicia 40 on fixed member 12 in the orientation shown. For example, end 66 of line 64 is aligned with and points to angular graduation 68 which indicates the 350° angular position relative to the 0° graduation 56. Line 70 is aligned with the 340° graduation, line 72 is aligned with the 330° graduation, and so forth. Thus, the ends 58, 66 and so forth of bridging lines 54, 64, 70, 72, 74, 76, 78, 80, 82, and 84 are spaced in integral multiples of the spacing of graduations 42 of indicia 40. In this case, the ends of lines 54, 64 and so forth are spaced on one-to-one basis with the spacing of graduations 42. This is by way of example only.

The other ends such as ends 60, 62 and so forth of the respective bridging lines 54, 64, 70, 72, 74, 76, 88, 80, 82 and 84 terminate in a circular array whose center is axis 20 of the inner disc 18. The location of these other ends 60, 62 is adjacent edge 50 of the inner disc 18 and are oriented such that rotation of that disc about axis 20 rotates arrow 48 in a direction to point to selected ones of these other ends. The particular bridging line to which arrow 48 points, points to indicia 40 and indicates the angular displacement of the reference point 32 from the primary axis 16 at that location of the arrow 48.

For example, with the outer disc 14 remaining stationary relative to the fixed member 12, the inner disc 18 is rotated clockwise in FIG. 2. Assume the point 52 of the arrow 48 is aligned with end 62 of line 64 whose other end 66 is aligned with the indicia 68. This indicates a ten degree displacement of the reference point 32 about the primary axis 16 to angle 350°. That is, upon rotation of the inner disc 18, when the reference point 32 is displaced about the primary axis 16 to the 350° position relative to the axis 16, the point 52 of the arrow 48 is aligned with the bridging line 64 at end 62 and indicates the 350° graduation 68 on the fixed member 12. What this means is that a straight line passing through primary axis 16 and reference point 32 will also pass through the 350° graduation indicia on member 12.

The additional bridging lines 70, 72, 74, 76, 78, and so forth, located, for example, in a 90° quadrant on the disc 14 and marked on the broad surface 24 of the disc 14, are spaced so that the arrow 48 point 52 may align with and point to the bridging lines 70–84 ends, such as ends 60, 62. This couples the arrow 48 tip 52 to the corresponding graduations 42 of the associated angular indicia 40 on the fixed member 12, indicating the relative angular displacement of the reference point 32 about the axis 16 in the quadrant in which the bridging lines are positioned.

As the inner disc 18 is rotated 180° from the position shown in FIG. 2, the arrow tip 52 will point to or between various bridging lines 54, 64, 70–84 and will, therefore, point to the corresponding angular scalar indicia 40 within a quadrant of outer disc 14 to indicate the angular position of the reference point 32 relative to the primary axis 16 anywhere within that quadrant.

As an aid in interpolation of the fractional angular increments between the graduations 42, equally spaced dots 86 or other graduations may be placed between the ends of the bridging lines, such as lines 54 and 64 at ends 58, 66. Additional dots 90 may be placed between the other bridging line ends 60 and 62. Similar dots or equivalent indicia are equally spaced between the ends of the remaining bridging lines 64, 72–84, as shown, each dot representing a 2° increment. If the arrow 48 is pointing to the dot 98, it would correspond to dot 100 at the edge of the outer disc 14 between bridging lines 72 and 74, indicating the position of the reference point 32 as being at the 326° angle. Other divisions between the dots (not shown) can also be included, if desired. Thus, the position of the angular location of the reference point 32 can be easily and accurately ascertained.

As the outer disc 14 is rotated about its axis 16 the quadrant of bridging lines 54, 64, 70–84 are thus rotated. Regardless the angular position to which the outer disc 14 is located, the bridging line ends 58, 66 and so forth point to a given portion of the angular scalar indicia 40 comprising a 90° portion. Rotation of the inner disc anywhere within a 180° range, provides an immediate indication of the relative angular position of reference point 32 to axis 16 in that quadrant. In other words, rotation of the discs 16 and 18 so that point 32 coincides with the location to be measured points arrow 48 to a bridge line or dot representing the angular displacement of the location with respect to the primary axis 16. It does not matter if a bridging line points to a graduation 42, a dot 86 or some point therebetween. The involved angle can be visually determined, by interpolation, if necessary.

To complete the point 32 polar coordinate position information, the value of the radial displacement of the reference point 32 from the axis 16 when the inner disc 18 is rotated relative to the outer disc 14 needs to be determined. This displacement may be designated as a $\rho$ value. The following indicia provide the $\rho$ information. When the inner disc 18 is rotated 180° from the position shown in FIG. 2, the reference point 32 is rotated until it is coincident with the dashed circle 34. At this point, the arrow 48 will be pointing to the 270° indicia assuming the outer disc 14 is positioned as shown. The reference point 32 is displaced a maximum radial distance from the axis 16. As can be now ascertained, reference point 32 can vary in radial displacement from the primary axis 16 from zero to a maximum value represented by the value of the radius of the circular dashed line 34.

To provide the relative radial displacement value of point 32, a second arrow 106 or straight line is marked on the outer disc 14 broad surface 24 adjacent and pointing to edge 50 of inner disc 18. Graduation indicia 110 are marked on the broad surface 26 of the inner disc 18. These graduations are spaced in increments equivalent, for example, to 1/10 increments of the value of the radius of the dashed circle 34. The increments of the radial displacement indicia 110 may have finer or larger graduations than those shown, in accordance with a given implementation. The zero of indicia 110 represents zero radial displacement of point 32 from primary axis 16, or the coincidence of point 32 with the axis. The unit indicia 1.0 represents the maximum displacement of point 32 from axis 16, or the coincidence of point 32 with dashed circle 34. The increments therebetween represent the relative proportionate displacement of point 32 from axis 16.

By way of example, when the inner disc 18 is rotated 90° clockwise from the position shown, the reference point 32 is half-way between the primary axis 16 and dashed circle 34. At that point the indicia graduation marked 0.5 on inner disc 18 will be aligned with the point 108 of arrow 106. This means that the reference point 32 is at the midpoint between axis 16 and circle 34. Note that by rotating the disc 18 from 0° to 180°, the point 32 is positioned anywhere between the primary axis 16 and the dashed circle 34 along a circle whose center is axis 20. In the alternative, indicia 110 could be marked with linear dimensions (e.g., millimeters) instead of fractional parts of the full radius.

By rotating the outer disc 14 to any angular position within a 360° circle about its axis 16, the bridging lines 54, 64, 72–84 are aligned with a selected 90° sector of the angular scalar indicia 40. Rotation of the inner disc 18 at that time locates the point 32 at a desired radial location relative to axis 16. In this way, the point 32 can be placed to any location within the area defined by the dashed line 34. The relative angle $\theta$ of the reference point from the primary axis 16 is easily determined by noting the bridging line 54–84 to which the arrow 48 points and reading the scalar angular indicia 40 at the other end of that bridging line. The radial displacement value is then read by observing the relative radial displacement value to which the second arrow 106 points. Thus, both angular and radial displacement values of the reference point 32 can be readily determined regardless the position of the point 32 within the desired area.

While a second arrow 106 has been shown on the outer disc 14 and the radial displacement indicia 110 shown on the inner disc 18, the reverse may also be provided. For example, the indicia 110 may be placed on the surface 24 of outer disc 14 and the arrow 106 may be placed on the inner disc 18 surface 26. Also, while a second arrow 106 is shown, this is only representative, as other indicia, such as a straight line, or a dot, may be employed.

By so marking the discs of the structure of the aforementioned U.S. Pat. No. 4,287,496 with the indicia as shown in FIG. 2, the polar coordinate position of the coupling probe of the waveguide may be readily identified. Thus, if it is known a priori where the reference point 32 for the probe is to be located in polar coordinates, by so setting the indicia of FIG. 2 on the various elements of the waveguide structure, the probe may be readily positioned to that polar coordinate location.

However, another embodiment may include indicia of the structure of FIG. 2 placed over clear substrates, such as transparent thermoplastic, celluloid, acrylics or other similar materials. In that case, the indicia may be readily referenced to an underlying surface over which the device of FIG. 2 is placed. In the alternative, the indicia may be electronic devices, such as wiper arms which wipe over conductors corresponding to indicia 110 and 40. The wiper arms may represent arrows 106 and 48. The wipers and conductors may be connected to a suitable power source and indicating devices such as LEDs or the like. The wipers may be thin wires for providing precise angular information.

What is claimed is:

1. A device for indicating the polar coordinate position of a point within a given area lying within a plane comprising:

a member including means bounding said area and having angular scalar indicia thereon circumscribing said area;

a first element rotatably secured to said member for rotation about a first axis at the origin of said angular scalar indicia normal to said plane, a portion of said first element of a given angular extent being adjacent said scalar indicia;

a second element rotatably secured to said first element for rotation about a second axis spaced from and parallel to said first axis, said second axis rotating with said first element about said first axis; and said second element including first and second indicia, said first indicia representing the location of said point, said first element including third and fourth indicia, said third indicia being positioned and formed on said first element to couple said first indicia to said scalar indicia for indicating the angular location of said point with respect to a reference point coincident with said first axis, said second and fourth indicia being positioned and arranged to provide radial reference indicia on one of said elements aligned with radial displacement scalar indicia on the other of said elements to indicate the value of the relative radial displacement of said given point with respect to said reference point at said angular location, said radial displacement scalar indicia having an extent representing the maximum radial displacement of said given point from said reference point.

2. The device of claim 1 wherein said first element is a first circular disc, said first axis being at the center of said disc, said second element is a second circular disc, said second axis being at the center of said second disc and located so that said first indicia can represent a position of said point being coincident with said first axis in one relative orientation of the second element to the first element.

3. The device of claim 2 wherein said first indicia includes a reference mark and said third indicia include coupling marks on said first element positioned to couple said reference mark to a given scalar indicia when that scalar indicia is coincident with a straight line through said point and said first axis and represents the actual angular position of said point relative to said first axis from said one relative orientation of the second element.

4. The device of claim 3 wherein said coupling marks include lines coupled to a quadrant of said angular scalar indicia regardless the angular position of said first element, said coupling marks being spaced adjacent said second element over a 180° segment of the edge of said second element.

5. The device of claim 2 wherein said reference indicia includes a reference mark on the one element and the radial displacement indicia includes scalar marks on said other element graduated to given incremental relative values of the radial position of said point from said origin and said first axis when said reference mark is aligned with a certain one of said scalar marks.

6. The device of claim 5 wherein said scalar marks are at the edge of said second element spaced to indicate equal incremental values of radial displacement of said point from said origin.

7. A device for indicating the polar coordinate position of a point within a circular area comprising:

a member having angular indicia equally spaced in a circular array around said circular area;

a first circular disc secured to the member for rotation about a first axis at its center and at the center of said circular area; and a second circular disc secured to the first disc for rotation about a second axis at its center at a location spaced from the first axis;

said second disc including a mark representing said point, said mark being coincident with said first axis in one reference relative orientation of the second disc to the first disc, said mark being coupled to a reference mark adjacent the edge of said second disc, said second disc including first indicia;

said first disc including coupling marks for coupling said reference mark to a given angular indicia on said member to indicate the relative angular orientation of said point to said first axis with respect to the one reference orientation, said first disc including second indicia, one of said first and second indicia including a reference mark and the other including scalar indicia for providing the relative radial displacement value of said point from said first axis.

8. The device of claim 7 wherein said one indicia reference mark includes a line adjacent the edge of said second disc on one of said discs and said scalar indicia includes graduation marks on the other of said discs adjacent said edge extending over an angular extent equivalent to the maximum displacement of said point from said first axis.

9. The device of claim 7 wherein said first disc coupling marks include lines spaced in an array with an angular extent of about 90°.

* * * * *